US012012186B2

(12) United States Patent
Barone

(10) Patent No.: US 12,012,186 B2
(45) Date of Patent: Jun. 18, 2024

(54) UNDERWATER MASK WITH WATER AND BREATHING AIR DISCHARGE SYSTEM

(71) Applicant: Mares S.p.A., Rapallo (IT)

(72) Inventor: Aristide Barone, Rapallo (IT)

( * ) Notice: Subject to any disclaimer, the term of this patent is extended or adjusted under 35 U.S.C. 154(b) by 765 days.

(21) Appl. No.: 17/197,453

(22) Filed: Mar. 10, 2021

(65) Prior Publication Data

US 2021/0284300 A1 Sep. 16, 2021

(30) Foreign Application Priority Data

Mar. 11, 2020 (IT) ..... 102020000005188

(51) Int. Cl.
*B63C 11/16* (2006.01)

(52) U.S. Cl.
CPC ..... *B63C 11/16* (2013.01)

(58) Field of Classification Search
CPC ... B63C 11/16; B63C 2011/165; B63C 11/02; B63C 11/12
See application file for complete search history.

(56) References Cited

U.S. PATENT DOCUMENTS

| | | | | |
|---|---|---|---|---|
| 2018/0297676 | A1* | 10/2018 | Zheng | B63C 11/16 |
| 2019/0023366 | A1* | 1/2019 | Liao | B63C 11/205 |
| 2020/0031441 | A1 | 1/2020 | Yihong | |

FOREIGN PATENT DOCUMENTS

| | | | | |
|---|---|---|---|---|
| CN | 204173146 U | * | 2/2015 | |
| CN | 106428476 A | * | 2/2017 | B63C 11/16 |
| CN | 108263578 A | * | 7/2018 | |
| DE | 102015010079 | | 2/2017 | |
| EP | 3517423 | | 7/2019 | |
| EP | 3604113 | | 2/2020 | |

OTHER PUBLICATIONS

Translation of CN_106428476_A (Year: 2017).*
Translation of CN_108263578_A (Year: 2018).*
Translation of CN_204173146_U (Year: 2015).*
Italian Patent and Trademark Office, Search Report, dated Sep. 25, 2020 (Relevant portions are in English).

* cited by examiner

*Primary Examiner* — Victoria Murphy
(74) *Attorney, Agent, or Firm* — Themis Law

(57) ABSTRACT

A mask for underwater use includes a frame, a transparent part supported by the frame, and a gasket part mounted on the frame and configured to be positioned on the face of a user. The gasket part has a perimeter edge adapted to rest on the perimeter of the user's face, and the perimeter edge includes a discharge opening, which is located at the region configured to be arranged near the user's mouth and which is the seat of a valve non-return mechanism, which enables the expulsion of breathed gases simultaneously with any water present in the lower chamber through the opening.

9 Claims, 5 Drawing Sheets

UNDERWATER MASK WITH WATER AND BREATHING AIR DISCHARGE SYSTEM

FILED OF THE INVENTION

The present invention relates to the field of diving masks, in particular for the so called "snorkeling" activity i.e., the practice of observing the marine environment while swimming on the surface with the head underwater.

BACKGROUND OF THE INVENTION

Generally, this kind of activity requires a mask provided with a transparent element to watch and a mouthpiece to breath. A mouthpiece is a tube having a free upper end designed to be placed out of the water and a lower end equipped with a shaped element that the user places into the mouth in order to inhale and exhale air.

Since mouth breathing is not natural and the transparent element of the mask tends to get fogged, masks with integral mouthpiece have been introduced that allow the nose to be also used for breathing.

Patent applications number 102018000001821, 102018000001826, 102018000001849, filed by the applicant of the present invention, refer to masks with integrated mouthpiece and are equipped, among other things, with specific devices to improve the functioning and generic use of the device such as, for example, the possibility of temporarily folding the ventilation tube, the improvement of the portion and shape of transparent surfaces for underwater vision, the improvement of the lateral exhaust tubes for the scope of safety and interaction with the remaining organs making up the respiratory mask.

These documents describe a mask of this type that comprises a frame fastening a transparent portion to a seal portion designed to be positioned on the diver's face. The seal portion has a septum designed to be rested on the user's nose, when the mask is worn, so as to form an upper chamber and a lower chamber, the lower chamber accommodating the nose and the mouth of the user. The two chambers communicate through a passage provided in the septum and through a one-way valve so that the air can flow from the upper chamber to the lower chamber and not vice versa.

The mask comprises a snorkel ("ventilation tube") divided in three dedicated non-communicating channels, the first central one, at the air inlet and the other two, which are lateral, at the air outlet. The snorkel is fitted in an upper opening of the frame such to put the central channel directly in communication with the upper chamber and the side channels with the lower chamber by means of a couple of ducts obtained in the frame. This way the air to be inhaled reaches the nose and mouth of the user by passing through the snorkel to the lower chamber by means of the upper chamber of the mask whereas the exhaled air is directly conveyed from the lower chamber to the snorkel in order to be ejected, the passage into the upper chamber being prevented by suitable flow control elements.

The undoubted benefits of this type of masks, also known as "Full Face" or FFM (Full Face Mask) masks lead to a certain increase in construction and design complexity following a greater number of components and organs compared to the simpler traditional masks which cover only the eyes and nose of the user, preventing him from breathing through the nose and forcing the use of a mouthpiece to be retained while breathing in diving.

Other advantages, including the ease of use of the FFMs, are in any case such as to justify this constructive commitment and therefore the applicant, continuously engaged in the development and improvement of this kind of products, feels the need to simplify some construction aspects by making non-obvious changes to the design of full face masks.

SUMMARY OF THE INVENTION

It is therefore an object the present invention to allow the implementation of a mask improved in the part involved in the purging of the breathed air and of the water coming out from the lower chamber. This is accomplished by means of a mask for underwater use comprising:

- a frame 1;
- a transparent part 2 supported by the frame;
- a gasket part 3 mounted on the frame 1 and adapted to be positioned on the face of a user, the gasket part 3 comprising:
- a partitioning wall 103 designed to rest on the user's nose when the mask is worn so as to form an upper chamber 203 and a lower chamber 303 sealingly separated from each other and with the lower chamber accommodating the user's nose and mouth, wherein the two chambers are connected through a passage provided in the partitioning wall 103 and at least one inner one-way valve 403 so that air can pass from the upper chamber 203 to the lower chamber 303 but not vice versa;
- a perimeter edge 503 designed to rest on the perimeter of the user's face to laterally delimit said upper chamber 203 and said lower chamber 103,
- where the perimeter edge 503 of the gasket 3 comprises one single discharge opening 30 which is located at the region designed to be arranged near the user's mouth and which is the seat of a valve-like non-return mechanism, the valve-like non-return mechanism comprising at least one valve seat 130 and a valve 230 and allowing the simultaneous expulsion from the lower chamber 303 of the breathed gases and of any water present in the said lower chamber 303 through to the said opening 30. This first embodiment is characterized by the presence of a single discharge opening 30, from which the air that the user emits with breathing passes through. The passage is forced thanks to the partitioning wall 103 which separates the upper chamber 203 from the lower chamber 303 so that the air exiting from the mouth and/or nose exerts an increase in pressure both on the internal valves 403 and on the valve 230, housed in the seat 130 and coupled with the opening 30. This pressure increase involves the at least partial opening of the valve-like non-return mechanism while the internal valves 403, operating in the opposite direction, remain closed, obstructing the passage of air in the upper chamber.

Conversely, during the inhalation act the opening 30 is blocked while the valves 403 allow the passage of external air from the upper chamber to the lower chamber, air which is then made available to the diver intent on inhaling.

Advantageously, the position of the opening 30 is such as to allow, during exhalation, also the purging of any unwanted liquids present inside the mask and in particular inside the lower chamber 303. When the mask is operating in a position so that its longitudinal plane is substantially parallel to the sagittal plane of the wearer, the force of gravity brings said liquids, mainly water, near the opening 30 and available for expulsion due to the exhaled air in transit through the same opening under the action of air pressure in the lower chamber 303.

In a preferred embodiment, the mask further comprises:

- a snorkel 4 comprising at least one first and one second channel 104, 204 which connect the upper chamber 203 and the lower chamber 303, respectively, with the external environment,
- at least one discharge duct 903 arranged on the perimeter edge 503 of the gasket 3 to convey the exhaled air into the second channel 204 of said snorkel 4, the exhaled air being conveyed into said snorkel 4 by means of a pair of small discharge ducts 903 arranged on the perimeter edge 503 and adjacent thereto,
- and further comprises a lower connection that is a lower connection 40 arranged in the lower part of the perimeter edge 503 of the gasket 3 near said discharge opening 30 so as to connect said discharge opening 30 with said at least one discharge duct 903 conveying therein the exhaled gases running from the outer valve.

In addition to the first embodiment, characterized by having one opening for the discharge of the exhausted air and of the water inside the lower chamber 303, this variant of the invention introduces an upper aeration tube divided into channels through which both the fresh air and exhaust air transit, the latter conveyed into the channel 204 through one or more ducts 903 which run on the perimeter edge and are connected at one end near the discharge opening 30 where a lower connection 40 is located to force the path of the air expelled into said ducts 903, with the significant advantage of not interfere with the diver's view.

According to other embodiments, the said lower connection 40 comprises at least one opening 240 accommodating at least one outer valve seat 50 supporting one bleed valve 60 to expel the water coming from the lower chamber 103 after passing through said discharge opening 30 and/or coming from at least one discharge duct 903.

In this way, a second ejection point is created for the filtered water (for example from the upper channel following the user's immersion behavior and/or from the water previously passed through the opening 30. The shape and number of openings of the fitting can be arbitrarily defined, as well as the valve-like non-return mechanism that in another embodiment is of the membrane type and comprises:

- a membrane cut-off 230 made of elastic, flexible material and preferably disk-shaped;
- a valve seat 130, preferably having circular or elliptical and substantially flat shape, comprising at least one passage opening surrounded by a continuous surface closed on itself that sealingly contacts at least one corresponding sealing lip of the membrane cut-off, and further has one or more central ribs which form an intermediate support for the disk composing the membrane cut-off 230, said ribs being arranged radially and in the plane of said valve seat 130.

Further characteristics and improvements are described hereinafter.

BRIEF DESCRIPTION OF THE DRAWINGS

The characteristics of the invention and the advantages deriving therefrom will be much clearer from the following specification of the accompanying figures, wherein.

DETAILED DESCRIPTION OF EMBODIMENTS OF THE INVENTION

Figure 1:
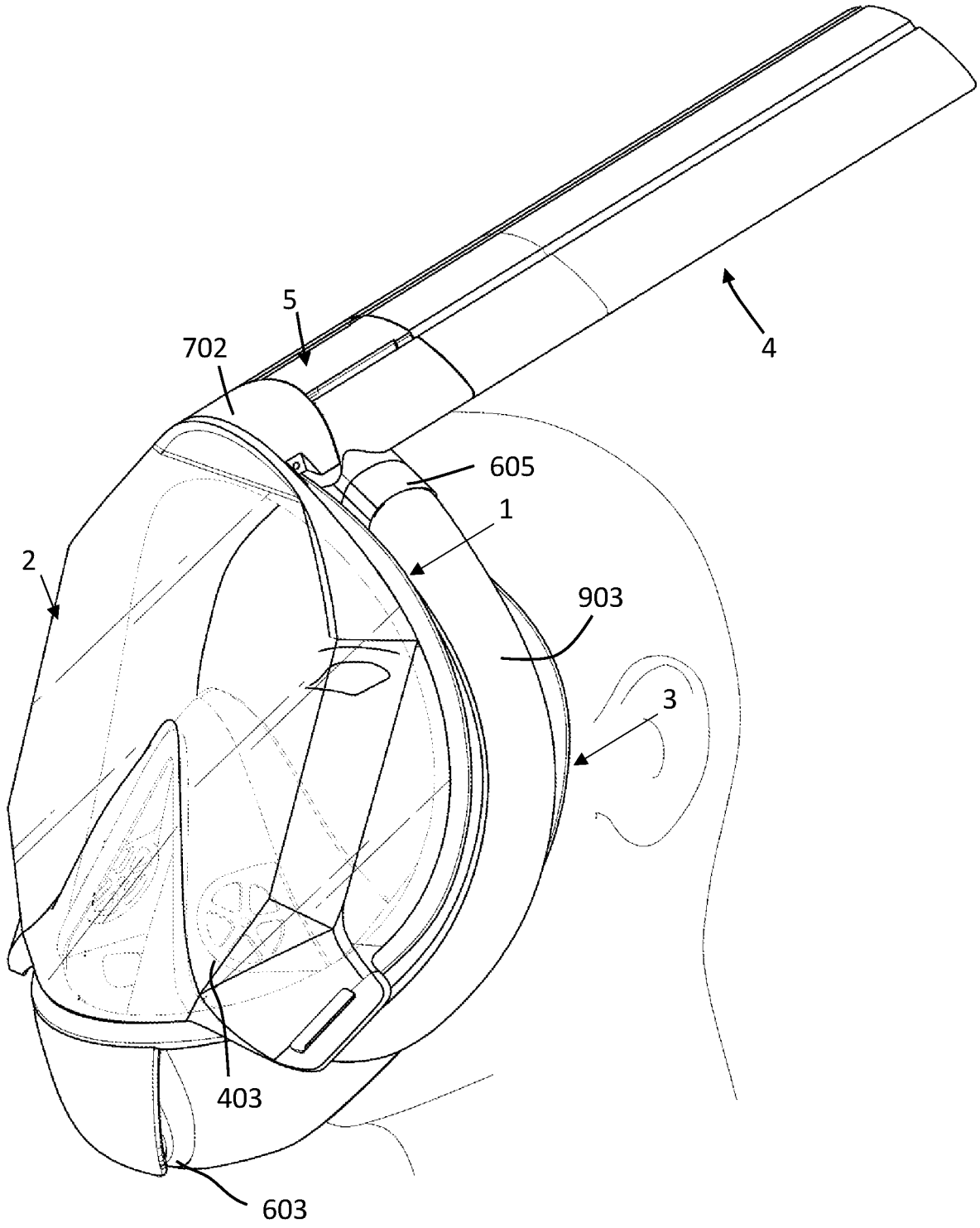
FIG. 1 shows a front view of a known FFM mask worn on the face of a user.
Figure 2:
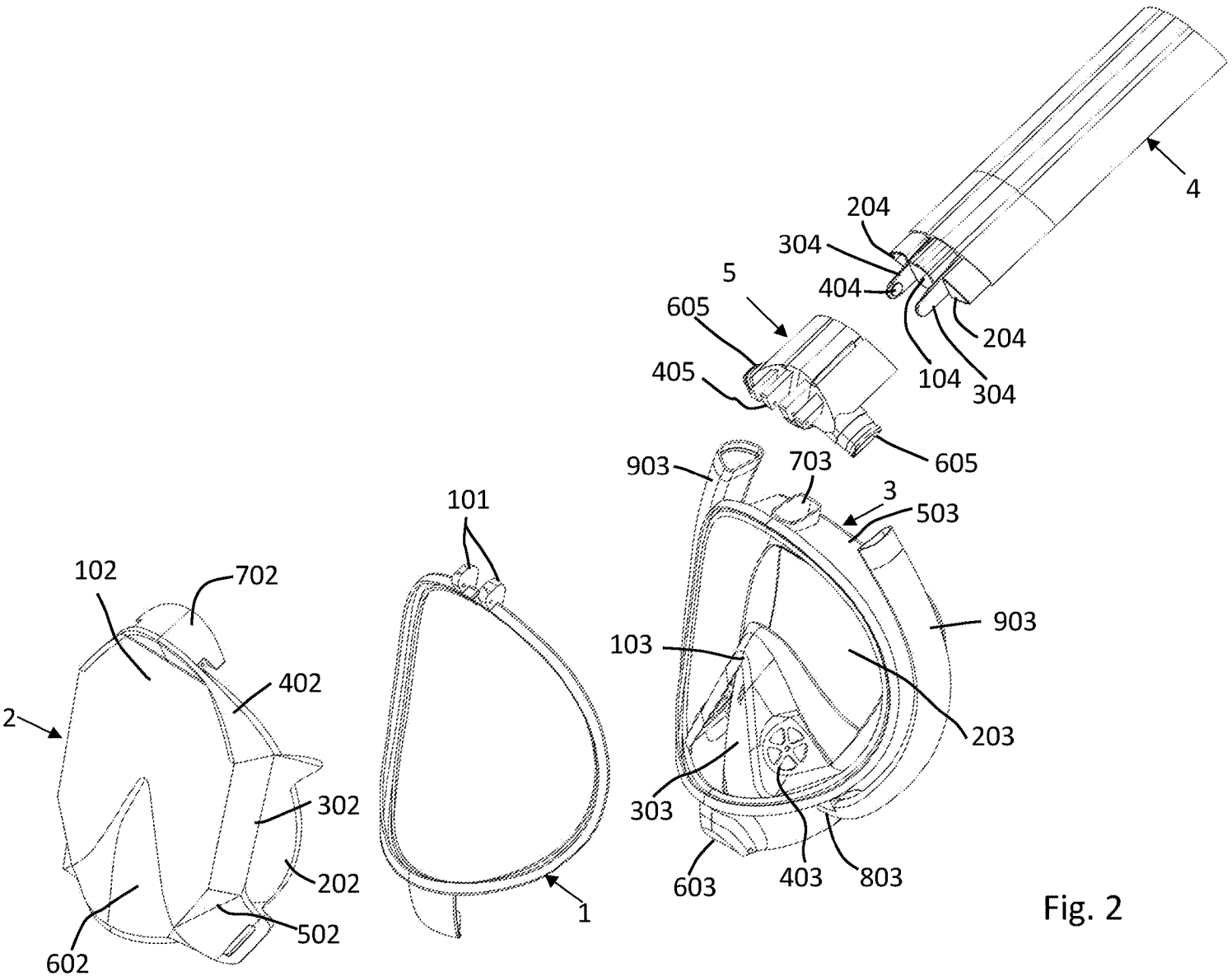
FIG. 2 shows an exploded view of the mask of FIG. 1.

With reference to FIGS. 1 and 2, the mask according to an embodiment comprises a frame 1 having a generally elongated shape, for example oval or the like, which fastens a transparent part 2 to a seal part 3 designed to be sealingly placed on and against the diver's face.

The seal part 3, made of rubber or other flexible material such as for example neoprene, has a partition wall 103 designed to rest on the user's nose, with the mask in the worn condition, such to form an upper chamber 203 and a lower chamber 303, the lower chamber 303 accommodating the nose and the mouth whereas the upper chamber 203 the eyes of the user.

The two chambers are in communication through a passage provided in the partition wall 103 wherein a one-way, in particular non-return, valve 403 is housed and oriented such that air can flow from the upper chamber 203 to the lower chamber 303 and not vice versa. In the embodiment shown, the valves 403, and the respective passages, are two arranged on opposite sides of the partition wall 103 with respect to a median longitudinal line, i.e. the sagittal plane of the user's head.

The mask comprises a snorkel 4 that puts the upper chamber 203 and the lower chamber 303 in communication with the outer environment and that will be described in detail hereinafter.

The transparent part 2, made of glass or plastic material, is the visor of the mask through which the user is able to see to explore the marine environment. In its simplest configuration, the transparent element has a smooth convex surface having a peripheral edge which follows the profile of the frame 1 to be fitted in a throat thereof. The coupling is of the type designed to make a seal and can provide that the edge of the transparent element is provided with a flange forming a protruding edge designed to be engaged into an undercut compartment of the throat provided in the frame 1.

The coupling can also take place by snap action or by shape coupling as in the known art.

In the embodiment shown in the figures, the transparent element 2 has a polygonal shape with squared connecting faces very shock- and scratch-resistant, affording a vision similar or even better than that of traditional masks.

Specifically, the transparent element 2, typically die moulded, is divided into a central part 102, in relief, having planar development and polygonal shape, which is connected to the perimetrical region 202 designed to be coupled to the frame 1, by the tilted polygonal shaped surfaces 302, 402, 502.

Underneath the central part 102 there is, at the partition wall 103 of the seal part 3, when the mask is assembled, a raised region 602 having polyhedral shape. Such raised region 602, advantageously consisting of plane surfaces having triangular shape and reciprocally connected and with the remaining of the transparent element 2, frontally delimits the lower chamber 303 and is intended to receive the user's nose.

The seal part 3, having an elongated configuration following the profile of the frame 1 and, more generally, the user's face, has a perimetrical edge 503 with four openings. The first one, positioned at the zone designed to be arranged near the user's mouth, accommodates a purge valve 603 to eject possible water that can enter the mask.

The second opening 703 is arranged on the top of the perimetrical edge to receive air to convey into the upper chamber 203 from the snorkel 4.

The other two openings 803 are positioned on opposite sides of the perimetrical edge 503 and lead to the lower chamber so as to receive exhaled air that is conveyed towards the snorkel 4 by means of a couple of exhaust ducts 903 arranged on the perimetrical edge 503 and adjacent thereto, as shown in the figures.

It can therefore be observed how the known mask gasket comprises four different openings to support and control the flow of air to and from the user. Only the opening 703 of them is not directly coupled to a valve while both the two openings 803 and the opening 603 accommodate a local non-return valve for controlling the flow of the fluids involved.

The snorkel 4 is divided in three dedicated non-communicating channels, the first central one 104 at the air inlet and the other two 204, which are lateral, at the air outlet. The snorkel 4 engages into the upper opening of the frame 703 such to put the central channel 104 directly in communication with the upper chamber 203 and the side channels 204 with the lower chamber 303 by means of the couple of exhaust ducts 903. This way the inhaled air reaches the nose and the mouth of the user by flowing through the snorkel 4 to the lower chamber 303 by means of the upper chamber 203 of the mask, whereas the exhaled air is directly conveyed from the lower chamber 303 to the snorkel 4, in the side channels 204 to be ejected.

The snorkel 4 has an upper connection terminal 5 between snorkel and mask, which upper terminal is intended to remain fastened to the mask and is connected to the snorkel 4 by means of an articulation having a coupling position in which the upper connection terminal 5 and the snorkel 4 are fastened in operating position and a releasing position of the snorkel 4 from the upper connection terminal 5 in which the snorkel 4 remains however connected to the upper connection terminal 5, but it is free to swing.

The upper connection terminal 5 has, in analogy with the snorkel 4, a central duct and the two lateral ducts (not visible in the figures) and a gap designed to accommodate corresponding winglets 304 on the snorkel 4 so as to simultaneously form a guide for sliding and an articulation. The winglets 304 are flattened appendices having a protuberance with button configuration 404 on the side facing the inside.

Said central duct of the upper connection 5, at the end opposite to the snorkel 4, has an opening below which engages in the hole 703 on the top of the perimeter edge 503 whereas each one of the two side ducts of said fitting leads to a corresponding side connection branch 605 onto which the corresponding exhaust duct 903 is inserted, the seal being generated by one or more seal parts 705.

The end of the upper connection 5 opposite the ventilation pipe 4 is closed and has winglets 405 for the engagement with corresponding winglets 101 on the frame 1, which winglets 101 are restrained in place by a coupling surface 702 which is located on the transparent element 2 when the mask is assembled.

In this embodiment the two exhaust ducts 903 branch off in a single piece from the seal part 3 and directly communicate with the lower chamber 303, whereas in different possible embodiments the exhaust ducts 903 are made as separate constructional parts that are removably connected with an end at an opening communicating with the lower chamber 303 and provided in the seal part 3, and with the other end at the upper connection terminal 5 similarly to the embodiment previously described.

The coupling takes place, for example, by a snap action interlocking coupling terminal consisting of a ring provided with a crown of radial teeth provided at the ends with axial tongues elastically flexible in radial direction and which teeth and tongues engage with the edge delimiting an opening provided in the seal part 3.

In both solutions, as well as in other possible solutions, there is a non-return valve with a diaphragm shutter which is oriented in such a way as not to allow the flow in the return direction from the exhaust pipe 903 to the lower chamber 303 between the end of the exhaust pipe 903 and the opening in the gasket 3. This valve has the role of preventing the entry of air into the lower chamber 303 during the inhalation phase, allowing instead the transit during the exhalation phase; with this arrangement, the transit of gases in the desired direction is obtained, that is, from the upper chamber to the lower one during inspiration and from the lower chamber towards the side channels 204 of the ventilation tube 4 passing through the exhaust duct 903 during exhalation.

Different embodiment variations are possible, which can comprise a separate non-return valve consisting of an independent constructional part and which is mounted at said opening in the seal part 3.

As mentioned above, the gasket 3 of the known mask comprises, in the perimeter edge 503, four different openings to support and control the flow of air to and from the wearer:

- the opening 703, arranged on the top of said edge 503, designed to receive air from the snorkel 4 through the channel 104, air which is conveyed into the upper chamber 203;
- the two openings 803, positioned on opposite sides of the perimeter edge 503 and leading into the lower chamber so as to receive breathed air which is conveyed towards the snorkel 4 by means of a pair of exhaust ducts 903 arranged on the perimeter edge 503 and disposed adjacent to it as shown in the figures. Each of these openings is paired with a non-return valve preferably mounted in correspondence with the related openings;
- a further opening, located in the area suitable for placing itself near the user's mouth and welcoming a purge valve 603 to expel any water that may enter the mask.

The present invention aims at improving, at least partially, the structure described above by reducing the number of openings in the gasket 3 and the number of flow control devices involved in the functioning of the mask. The obvious advantages can be found in better water tightness, easier construction and resistance to stress and greater durability.

Figure 3:
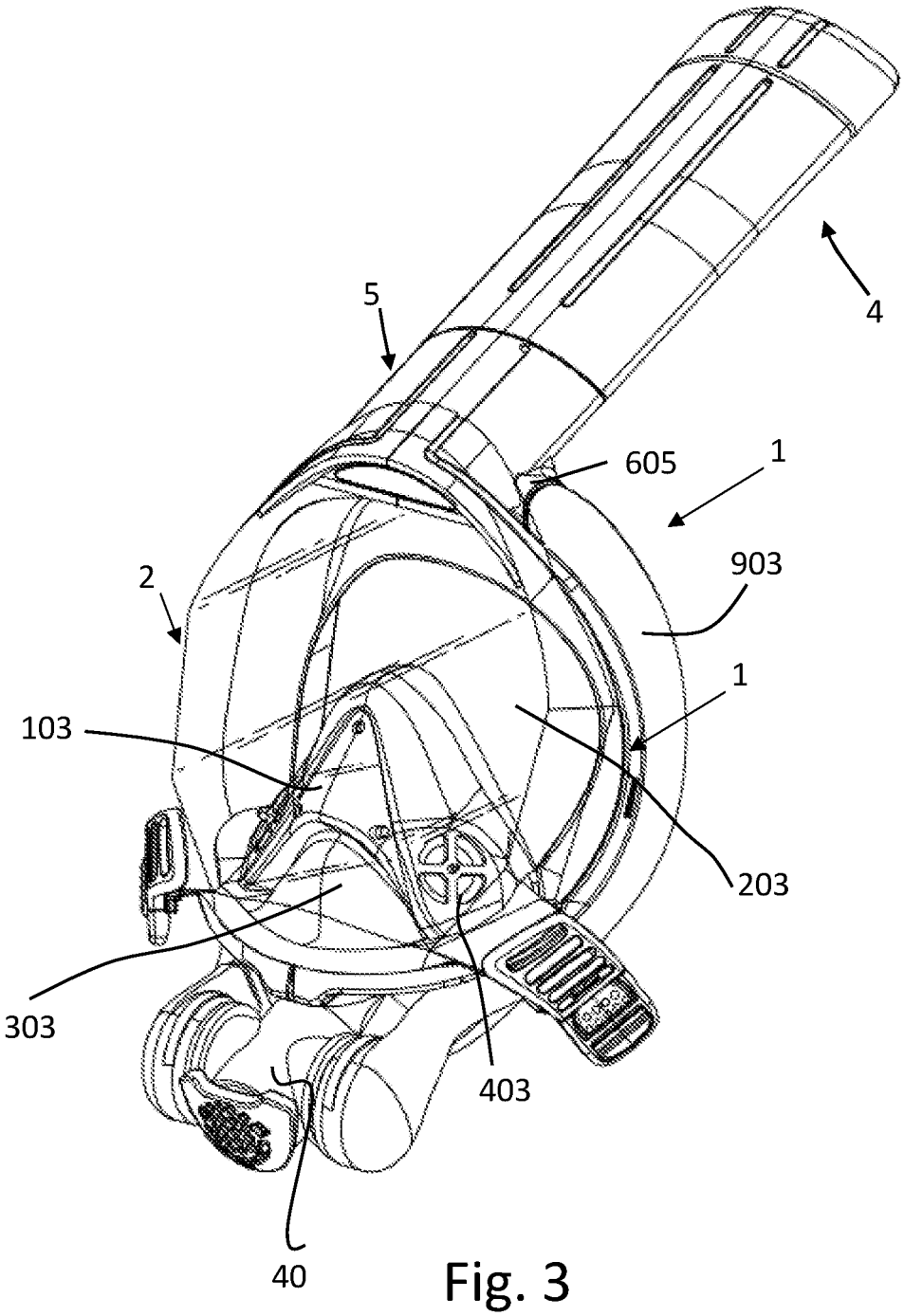
FIG. 3 shows a front view of a possible embodiment of the mask according to the present invention.
Figure 4A:
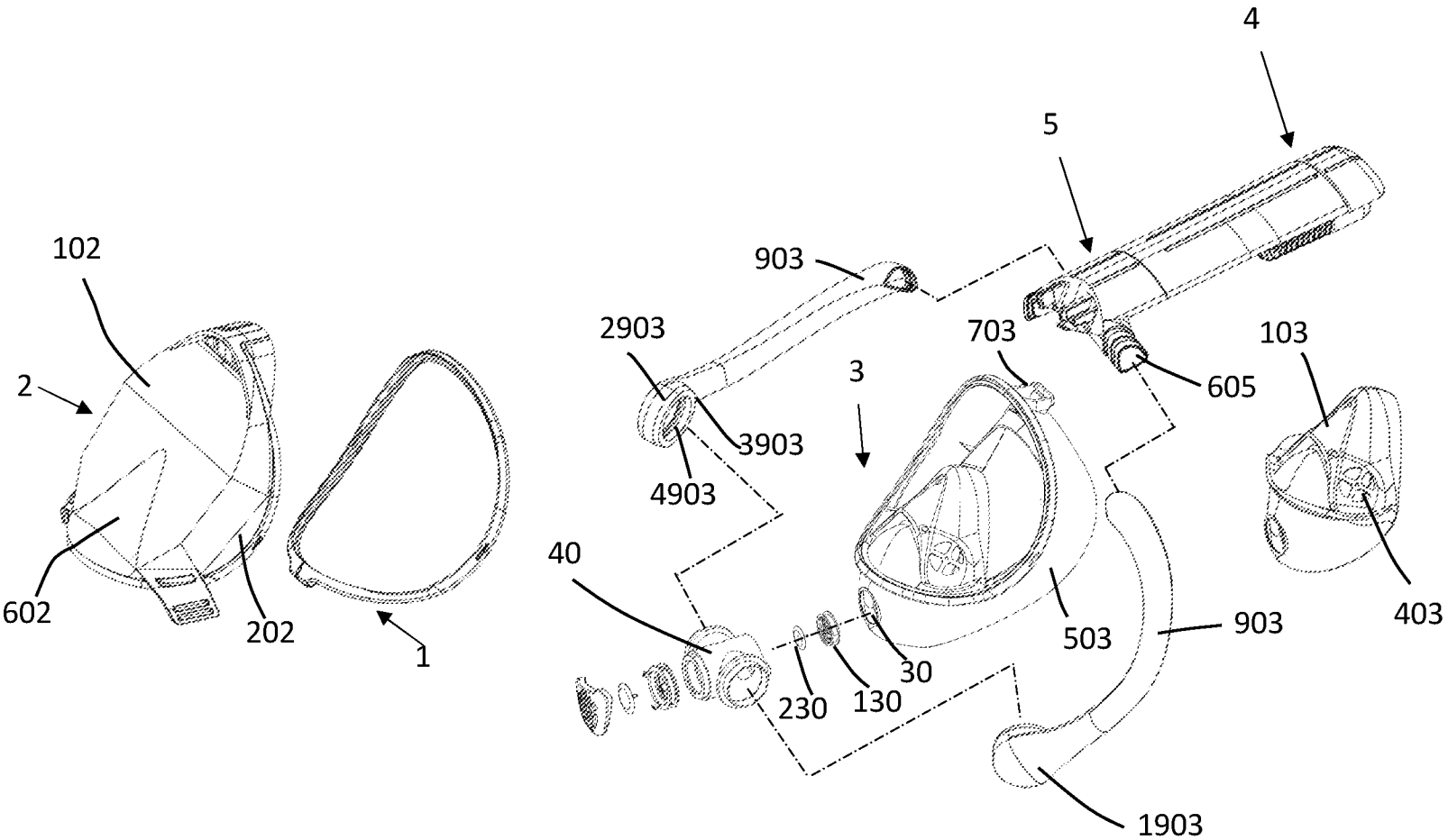
FIG. 4*a* shows an exploded view of the mask of FIG. 3, where the detail of the fluid collection fitting is further documented in FIG. 4*b*.

An embodiment of full face mask according to this invention is shown in FIG. 3 and the same embodiment is shown in exploded view in FIG. 4. In FIG. 3 and following, the numerical references of the previous descriptions have been reused for unchanged elements while new references have been introduced to support the description of the innovative components described here.

From the comparison between FIG. 1 and FIG. 3 it is possible to find some of the improvements introduced by this invention, which will be better described below with the help of FIG. 4. It can be noted the presence of a lower connection element 40, located near the user's mouth and intended to collect and convey the breathed air exiting from the lower chamber 103 which passes through the opening 30 as a consequence of the user's expiratory act.

The embodiment of said lower connection 40 must be read as indicative and not limiting of the possible other embodiments according to the invention. In particular, the conformation having cylindrical sections can be varied in terms of ergonomic and/or aesthetic and/or functional aspect of the mask for underwater use still remaining within the inventive concept herewith presented.

In this sense, according to a further characteristic that can be provided in any combination or alternatively with one or more of the other characteristics described in this description, the lower connection 40 can be made in one piece with the transparent part 2 whereas still according to a further feature that can be provided in any combination or alternative with one or more of the preceding features, the lower connection 40 can be made in one piece with the frame 1.

The two discharge ducts 903 departs from the lower connecting element 40 and they are modified with respect to the mask of FIG. 1 and so not directly interconnected to the perimeter edge 503, said ducts being located adjacent to the perimeter edge 503 of the gasket 3 and being connected, at the opposite end with respect to the lower connection 40, with the upper terminal connection 5 to which they engage by means of a side connection 605 and possibly joining sealing gaskets (not shown in the figure).

The exhaust ducts 903 can be made in different shapes and materials according to the embodiment and/or be at least partially made in one piece with the gasket 3 or removable or integrated in the body of the mask as for example in the frame 1.

The exhaust ducts also engage with the lower fitting 40 in correspondence with the relative opening 140, said fitting being furthermore equipped with:

(a) an opening 340, combined with the corresponding opening 703 in the gasket 3;

(b) an opening 240 intended to contain a purging element from which the breathed gas is expelled as well as any water that filters inside the lower chamber 303 during underwater operations.

Figure 4B:
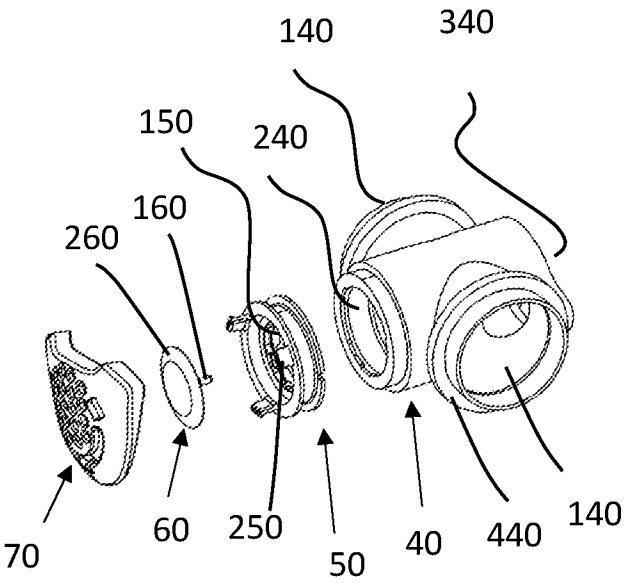

In this embodiment, the purging element is composed of a membrane type valve, comprising a valve seat 50 and a shutter disk 60 as shown in FIG. 4*b*. A protecting and containing element 70, provided with specific openings, is fixed in front of the valve seat 50, hooked in a known way, in order to protect the valve and the shutter from foreign bodies even allowing the fluids to transpire and also in order to improve general aesthetics of the mask.

In this variant, the membrane valve as known in the state of the art therefore comprises a shutter disk 60 of flexible elastic material housed in a valve seat 50 which is provided with at least one passage opening 150. The shutter disk 60 comprises fixing means 160 to the valve seat 50. In this example the said fixing means engage in at least one corresponding fixing housing 250 of the valve seat 50. Said fixing housing has a central engagement hole for a pin that locks part of the shutter disc to the valve seat. The valve seat 50 also comprises a continuous and closed surface for contact sealing of at least one corresponding sealing lip 260 that is part of the shutter disk 60.

According to a still further characteristic that can be provided in any combination or alternatively with one or more of the preceding characteristics, the valve seat 50 can be made in one piece with the lower fitting 40 obtaining numerous advantages also in terms of number of parts needed to build the mask object of this invention but also in terms of simplicity of construction, maintenance and production cost containment.

In other embodiments, not shown in the figures, the membrane shutter can be made of one piece and of the same material with the gasket part 3, being separated along its peripheral edge from the said gasket part by appropriate buttonholes which delimit said perimeter edge and which have a predetermined width, while the said membrane shutter is connected to a support wall by at least two rigid material bridges which are provided on opposite sides of the perimeter edge of said membrane shutter.

For the scope of coupling between the lower connecting element 40 and the exhaust ducts 903, each duct can be made in specific variants where it is provided with an interlocking seat 1903 at one end; said interlocking seat comprises an internal groove of annular shape 4903 or of other shape designed to be coupled with a corresponding annular flange 440, present in the lower connection 40, which forms an external radial winglet intended to engage by elastic forcing with said internal groove.

The invention claimed is:

1. A mask for underwater use, comprising:

a frame;

a transparent part supported by the frame;

a gasket part mounted on the frame and designed to be positioned on a face of a user, the gasket part comprising:

a partitioning wall designed to rest on the user's nose when the mask is worn so as to form an upper chamber and a lower chamber sealingly separated from each other and with the lower chamber configured to accommodate the user's nose and mouth, wherein the upper chamber and the lower chamber are connected through a passage provided in the partitioning wall and at least one inner one-way valve so that air can pass from the upper chamber to the lower chamber but not vice versa; and a perimeter edge designed to rest on the perimeter of the user's face to laterally delimit said upper and said lower chamber, wherein the perimeter edge of the gasket part comprises one single discharge opening, which is located at a region adapted to be arranged near the user's mouth and which is a seat of a valve non-return mechanism, the valve non-return mechanism comprising a valve seat and a valve applied to said single discharge opening for expulsion from the lower chamber of breathed gases and simultaneously with any water present in said lower chamber;

a snorkel comprising at least one first channel and at least one second channel which connect the upper chamber and the lower chamber, respectively, with an external environment;

at least one discharge duct arranged on the perimeter edge of the gasket to convey exhaled air into the at least one second channel of said snorkel by means of a pair of discharge ducts arranged on the perimeter edge and adjacent thereto; and a lower connection arranged in a lower part of the perimeter edge of the gasket near said one single discharge opening with said at least one discharge duct configured to convey therein the exhaled air running from an outer valve;

wherein the mask is configured such that the exhaled air enters the one single discharge opening prior to entering the at least one discharge duct.

2. The mask for underwater use according to claim 1, wherein the outer valve comprises at least one outer valve seat and a bleed valve, and further wherein said lower connection comprises at least one opening accommodating or integral to the at least one outer valve seat that contains the bleed valve to expel the water coming from the lower chamber and/or coming from the at least one discharge duct.

3. The mask for underwater use according to claim 1, wherein the valve non-return mechanism is of membrane type and comprises:

the valve, comprising a membrane cut-off made of an elastic, flexible material; and the valve seat comprising at least one passage opening surrounded by a continuous surface closed on itself that sealingly contacts at least one corresponding sealing lip of the membrane cut-off, and further has one or more central ribs which form an intermediate support for the membrane cut-off, said ribs being arranged radially and in a plane of said valve seat.

4. The mask for underwater use according to claim 1, wherein the snorkel has an upper terminal connection between the snorkel and the mask, the upper terminal connection being fixed on the mask and being connected to the snorkel with a joint which has a coupling position in which the upper terminal connection and the snorkel are fixed in operating position and a releasing position from the upper terminal connection in which the snorkel remains connected to the terminal connection, but can freely swing.

5. The mask for underwater use according to claim 4, wherein the upper terminal connection comprises a central duct and two side ducts, the central duct and the two side ducts engaging, at an end thereof, extensions of the at least one first channel and the at least one second channel of the snorkel, wherein an opposite end of the upper terminal connection is closed and has winglets for engaging corresponding winglets that are on the frame, the corresponding winglets on the frame being held in position by a hooking surface present on the transparent part when the mask is assembled.

6. The mask for underwater use according to claim 5, wherein the upper terminal connection has a pair of openings for engaging the pair of discharge ducts, the pair of discharge ducts connecting the lower chamber with the at least one second channel of the snorkel.

7. The mask for underwater use according to claim 6, wherein the pair of discharge ducts are connection tubes arranged outside both the frame and the gasket part.

8. The mask for underwater use according to claim 6, wherein the pair of discharge ducts are located within the frame.

9. The mask for underwater use according to claim 1, wherein the transparent part has a polygonal shape with squared connecting facets.

* * * * *